US011341835B1

(12) United States Patent
Hausler

(10) Patent No.: US 11,341,835 B1
(45) Date of Patent: May 24, 2022

(54) SECURITY AND SAFETY MONITOR

(71) Applicant: Graham Speier Hausler, Bend, OR (US)

(72) Inventor: Graham Speier Hausler, Bend, OR (US)

( * ) Notice: Subject to any disclaimer, the term of this patent is extended or adjusted under 35 U.S.C. 154(b) by 0 days.

(21) Appl. No.: 17/027,417

(22) Filed: Sep. 21, 2020

(51) Int. Cl.

| | |
|---|---|
| ***G08B 21/14*** | (2006.01) |
| ***G08B 17/10*** | (2006.01) |
| ***G08B 17/06*** | (2006.01) |
| ***G08B 21/18*** | (2006.01) |
| ***G08B 21/16*** | (2006.01) |

(52) U.S. Cl.
CPC ..... *G08B 21/14* (2013.01); *G08B 17/06* (2013.01); *G08B 17/10* (2013.01); *G08B 21/16* (2013.01); *G08B 21/182* (2013.01)

(58) Field of Classification Search
CPC ..... G08B 21/14; G08B 17/06; G08B 17/10; G08B 21/16; G08B 21/182
USPC ..... 340/632
See application file for complete search history.

(56) References Cited

U.S. PATENT DOCUMENTS

| | | | | |
|---|---|---|---|---|
| 5,798,704 | A * | 8/1998 | Sabuncu | G01V 1/008 340/692 |
| 6,133,839 | A * | 10/2000 | Ellul, Jr. | G08B 7/062 340/331 |
| 7,420,473 | B2 * | 9/2008 | Eicken | A01K 15/021 340/573.1 |
| 8,033,686 | B2 * | 10/2011 | Recker | H05B 45/357 362/249.02 |
| 9,384,647 | B1 * | 7/2016 | Arnold | G08B 21/02 |
| 10,152,866 | B2 * | 12/2018 | Kraz | G08B 17/113 |
| 2018/0013271 | A1 * | 1/2018 | Goulden | F16M 11/14 |
| 2019/0230259 | A1 * | 7/2019 | Germe | G08B 13/19619 |
| 2020/0018469 | A1 * | 1/2020 | Kohen | G08B 13/196 |

* cited by examiner

*Primary Examiner* — John A Tweel, Jr.
(74) *Attorney, Agent, or Firm* — Mark S Hubert

(57) ABSTRACT

A battery powered do-it-yourself (DIY) security and safety monitor that is removably mounted by a self-centering magnet mount onto a ferromagnetic wall plate. The monitor has numerous sensors that report anomalies to the owner's smart device or a pay-for-use monitoring service through cellular communication. There is a smart hub incorporated directly to the various sensors or to the sensors through the main system microprocessor to allow communication and control of the various sensors and modules (if applicable) via the owner's smart device. The monitor may be hard wired into the premises if required by code, or it may be battery powered by long lasting Lithium batteries.

15 Claims, 8 Drawing Sheets

FIG 1
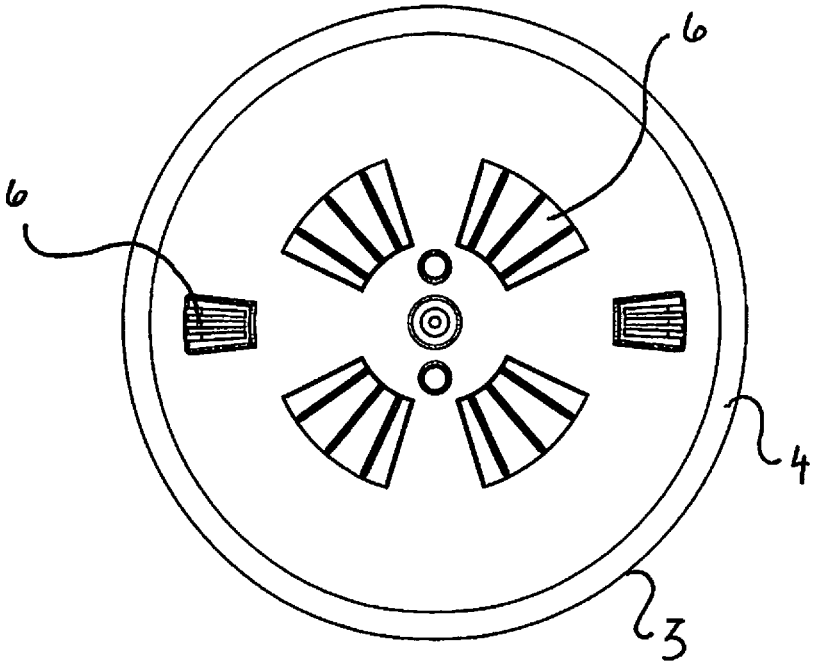
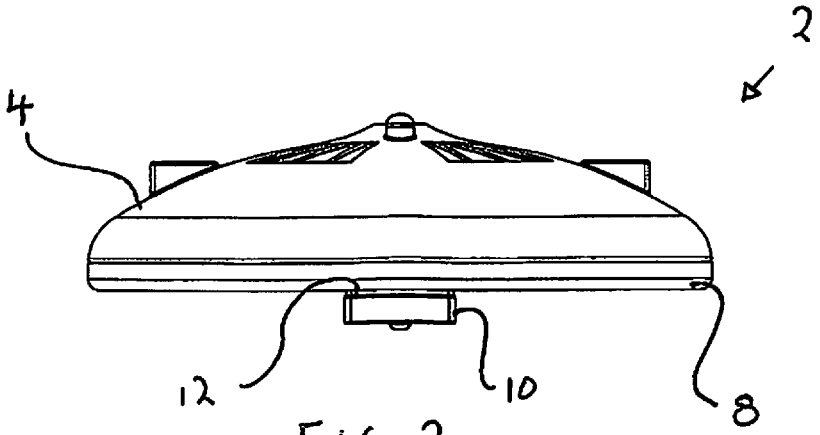
FIG 2

SECURITY AND SAFETY MONITOR

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to do-it-yourself security/monitoring systems, and more particularly to comprehensive monitoring sensor.

BACKGROUND

A burglary takes place about every eighteen seconds in the United States which corresponds approximately 4,800 every day. The average property dollar loss per burglary is a staggering $2,251. U.S. fire departments respond to an average of one home fire every 86 seconds. The average fire damage repair is $13,500. Many municipalities have instituted building codes requiring CO alarms. For such reasons, the commercially monitored home security and safety business is booming.

The sophistication of electronic security and safety devices has increased dramatically over the last decade. Great strides have been made in the do it yourself security industry. The days of having the entire house wired to incorporate window and door sensors are gone with the advent of the newer electronic sensors. The future of home security is a fully integrated system of security, safety and communication accessible and controllable over the internet. Physical wiring connections are a thing of the past. However more than ever, with all of the new electronic monitoring options available, the typical consumer wants more protection out of their monitoring system. The simple alarm when a door or window is breached is no longer adequate. Consumers want interactive camera systems where they can see hear and talk to their pets from work. There is a plethora of things the average consumer wishes to know about when they are not home. They want to know the air in their house is safe. They want photographs for identification of intruders. They want immediate alerts of intrusion to their cell phones. They want to know if their furnace malfunctions while they are away. They want to know if a water line has broken. They want to know if there is smoke in the house.

Consumers will pay for a comprehensive home monitoring system. They realize that the price of a home security/monitoring system pales in comparison to the emotional and monetary cost of making one whole after burglary, fire or water damage.

Unfortunately, prior to now this type of comprehensive monitoring involved multiple systems, each with their own sensor and wiring and an installation required a professional installer. This left the house looking rather "busy". This also was expensive as it required multiple contracts with different security/home monitoring companies.

Henceforth, a simpler, comprehensive, multi-parameter monitoring system with multiple monitors capable of audible and video communication therebetween, that requires no wires, and can be installed by the average homeowner would fulfill a long felt need in the home monitoring industry. This new invention utilizes and combines known and new technologies in a unique and novel configuration to overcome the aforementioned problems and accomplish this.

BRIEF SUMMARY

In accordance with various embodiments, a home monitoring system capable of DIY mounting and setup is provided.

In one aspect, a do-it-yourself (DIY) monitoring system adapted for simple, adjustable installation, intended for use with multiple monitors mounted at strategic locations around the building.

In another aspect, a system adapted for monitoring multiple parameters and providing action signals and alerts to a commercial monitoring service as well as directly to the homeowner.

In yet another aspect, an adhesive DIY wall/ceiling mountable monitoring system adapted to allow the self-centering, adjustable magnetic coupling of a multi element monitor.

In another aspect, a code fire/smoke alarm that notifies the homeowner of its battery status so that it never fails during sleeping hours and awakes the tenant.

In another aspect, to create a smart replacement for NFPA code compliant smoke detectors using existing wiring or fire rated Cath cable for new construction or using a wireless system of communication.

In a final aspect, a mountable security system or a series of units that provide room to room continuous audible and video communication capabilities tied to the operation of some or all of the safety and security features of the unit.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 1 is a front view of the monitor;

FIG. 2 is a side view of the monitor;

Figure 3:
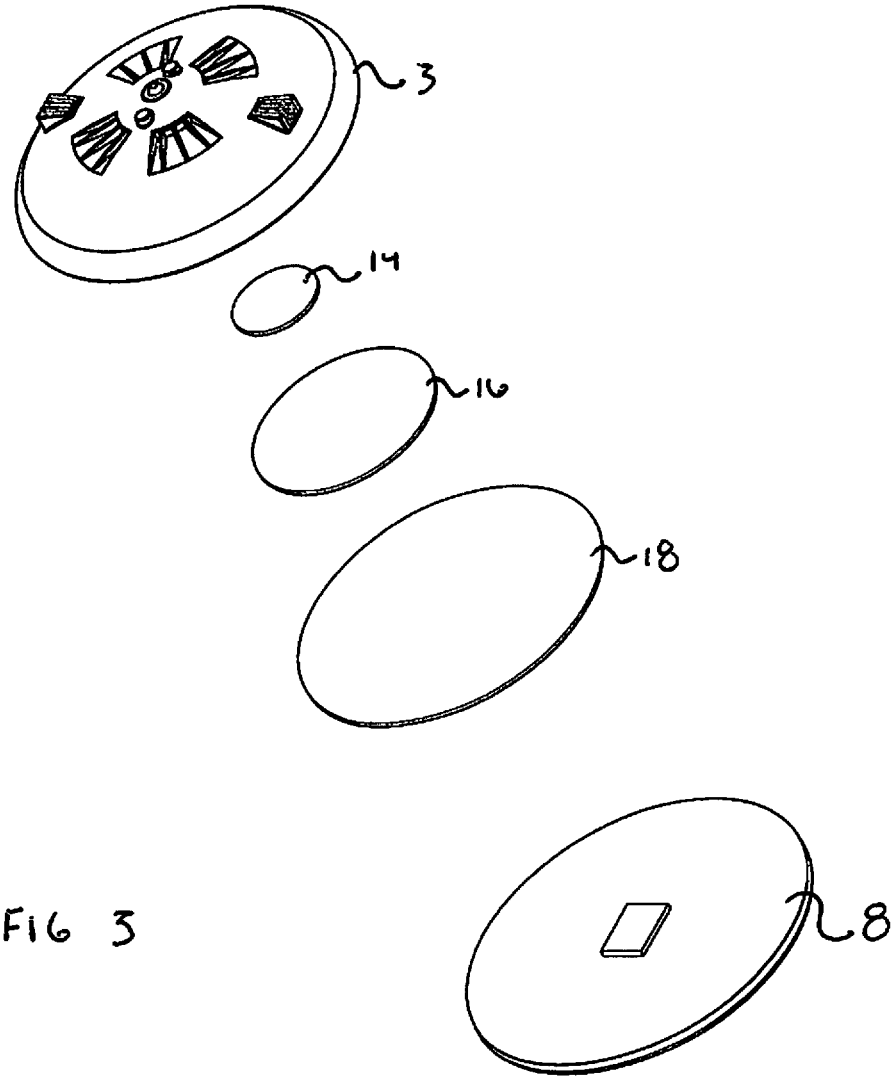
FIG. 3 is an exploded view of the monitor.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, components, circuits, and networks have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "sensor" and "sensor module" refer to an electronic device capable of monitoring for a substance, movement, sound, odor, humidity, particulate matter or temperature, and processing a data or control signal related to the element monitored, that is communicated to a main system microprocessor for action. These include proximity sensors, smoke sensors, combustible gas sensors, CO sensors, glass breakage detectors, Radon detector sensors, microphones, sound sensors, shock sensors, heat sensors, low temperature sensors, humidity sensors and the like including all of their operational electronic components including but not limited to processors, batteries, power convertors, battery power monitoring circuitry and microprocessor, cellular network modules, wireless transceivers, mesh network modules, cellular transceivers and cameras.

The present invention relates to a security system with a series of comprehensive monitors, each with a novel design for adjustably, magnetically attaching to a DIY ferromagnetic mounting plate that can be affixed in a planar fashion to any wall or any ceiling, and can be affixed to any corner or any wall-ceiling interface regardless of the included angle. The mounting system is incorporated by reference and is disclosed in U.S. patent application Ser. No. 16/987,161.

The monitor 2 is intended to be but a single element in a complete integrated security, communication, home automation and eventually, AI system. It is connected to all home automated devices via the smart hub, and the other monitors via wireless communication protocols such as WiFi, Bluetooth and cellular. It will allow two way communication with and from each unit seamlessly to the monitoring entity (computer or smart device) as well as integration with voice responsive AI systems such as Amazon's Alexa®, or Google's Home Assistant®, and other home devices connected to a smart hub. All data feeds/signals for the building are sent to the monitors 2. This enables the homeowner/occupant to walk freely around the building while issuing commands to control building equipment and amenities, get information from sensors or talk uninterrupted with another person on the phone. Simply stated, this device will bridge security and safety systems with artificial intelligence and other smart hub controlled devices around the building such as telephones, door locks, music systems, lights, air conditioners, furnaces, tv, appliances, sensors, cameras, alarm panels and the like.

This security and safety monitor was designed as a smart replacement for NFPA code compliant smoke detectors. All units have a long life battery and may be supplementally powered/connected as required in new construction (with—Cat 5,6 or Current Code Wiring Configurations); or retro-fit into existing code smoke detector wiring to replace old with new; or used as a portable version. It was designed to be used in conjunction with a complete building (home or business) security and safety system with multiple units in various locations about the building. The units will all be in communication with each other so as to share data about the building's status as well as allow the owner to verbally communicate his queries and directives to the system from any of the units seamlessly as they walk freely about the building.

It is envisioned that the system will operate without a tactile control panel or keypad, rather the entire system will be controlled with a downloaded, custom built control Application for the homeowner's cell phone/mobile device. From this application the homeowner will be able to access many of the sensor outputs/alarms as well as operate some of the devices such as an optional motorized camera.

Simple door and window alarms that were hard wired into the building structure and having "make or break" alarm contacts, were the standard for security systems for years. With the advent of smaller more powerful microprocessors and the advances in electronic technology, these monitoring sensors have been replaced by wireless proximity sensors and the like. Additionally, the rise of cellular phones, WIFI, Bluetooth and other wireless communication systems have eliminated the need for hard wire alarm systems, except for redundancy and in the case of a need for ultra-security. The present invention incorporates a multitude of communication devices with security and safety sensors into a comprehensive monitor.

Looking at FIGS. 1 and 2 it can be seen that the security and safety monitor (hereinafter "monitor") 2 has a circular shell 3 with a domed top face 4 having numerous openings 6 formed therethrough, from which different monitoring sensor elements extend therethrough. There is a battery pack 8 with a central magnet mount 10 affixed to is rear face by an adhesive means 12 preferably double sided tape. Between the shell 3 and the battery pack 8 an enclosed void is formed where are housed the internal electronics of the various sensors. These sensor electronics are arranged on a stacked set of three printed circuit boards (PCBs) which house among other operational components, the microprocessors for the various sensors and battery monitoring system.

The exploded view of FIG. 3 shows how the upper printed circuit board (PCB) 14, middle PCB 16 and bottom PCB 18 are nested in a stacked arrangement between the shell 3 and the battery pack 8. The PCBs increase in surface area and diameter from the top to the bottom of the shell 3 as does the diameter of the domed configuration of the shell 3. The PCBs reside parallel to the bottom face of the shell.

Figure 5:
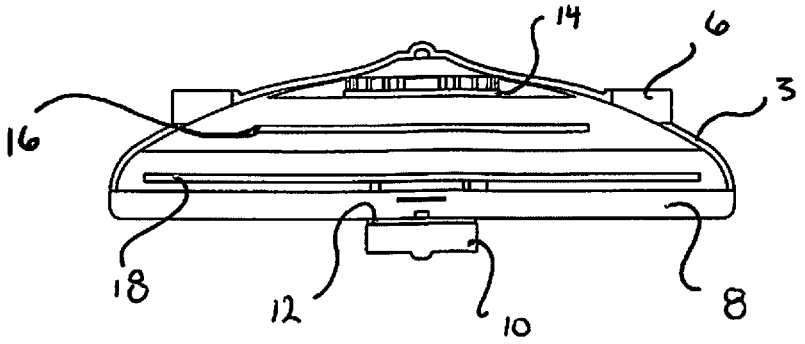
FIG. 5 is a cross sectional view of the monitor taken through the section line A-A of FIG. 4.
Figure 4:
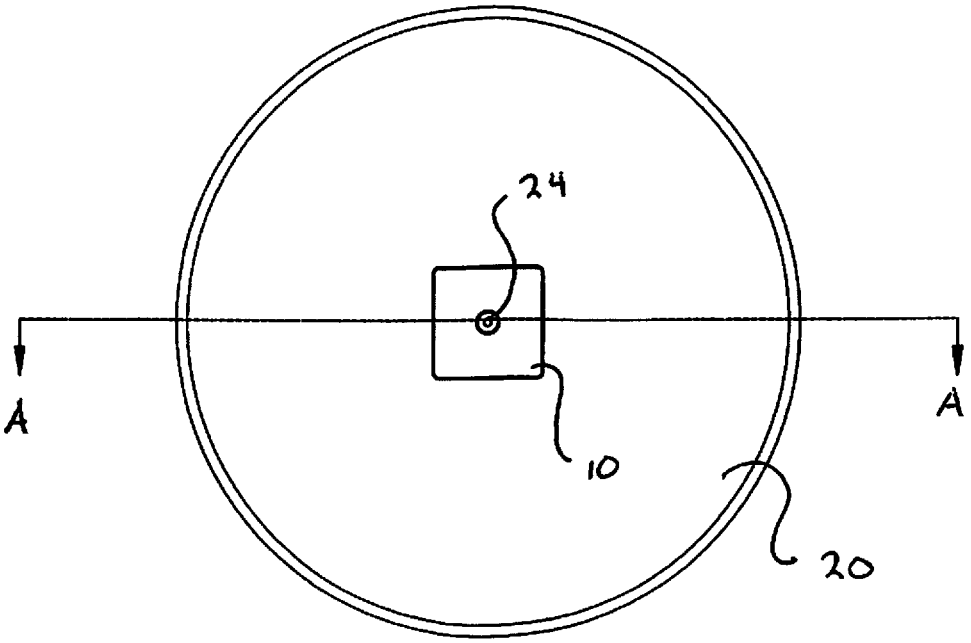
FIG. 4 is a back view of the monitor with section line A-A.
Figure 7:
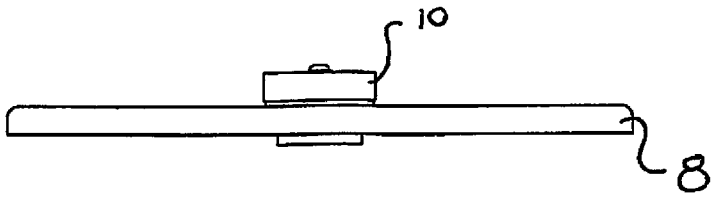
FIG. 7 is a side view of the battery pack with its interface connector and magnetic mount.

Looking at the cross-sectional view of FIG. 5 taken through the sectional line A-A of FIG. 4, the arrangement of the enclosure and the PCBs can best be seen. Although not depicted for visual clarity, there are mechanical polymer standoffs that set the spacing between the three PCBs to eliminate any mechanical interference between components, to minimize the electronic cross interference between components and to ensure adequate heat removal from the components. Generally, these are just small legs extending normally from the faces of the PCBs. The electrical connection between the battery and the various sensor electronics on each PCB may be routed through or on these standoffs.

Figure 6:
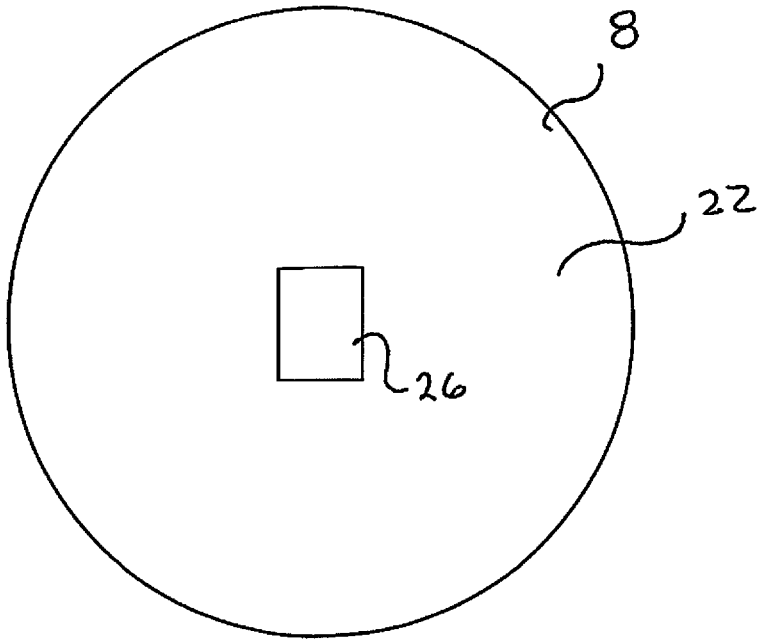
FIG. 6 is a top view of the battery pack with its interface connector and magnetic mount.
Figures 8A, 8B, 9, 10, 11, 12, 13:
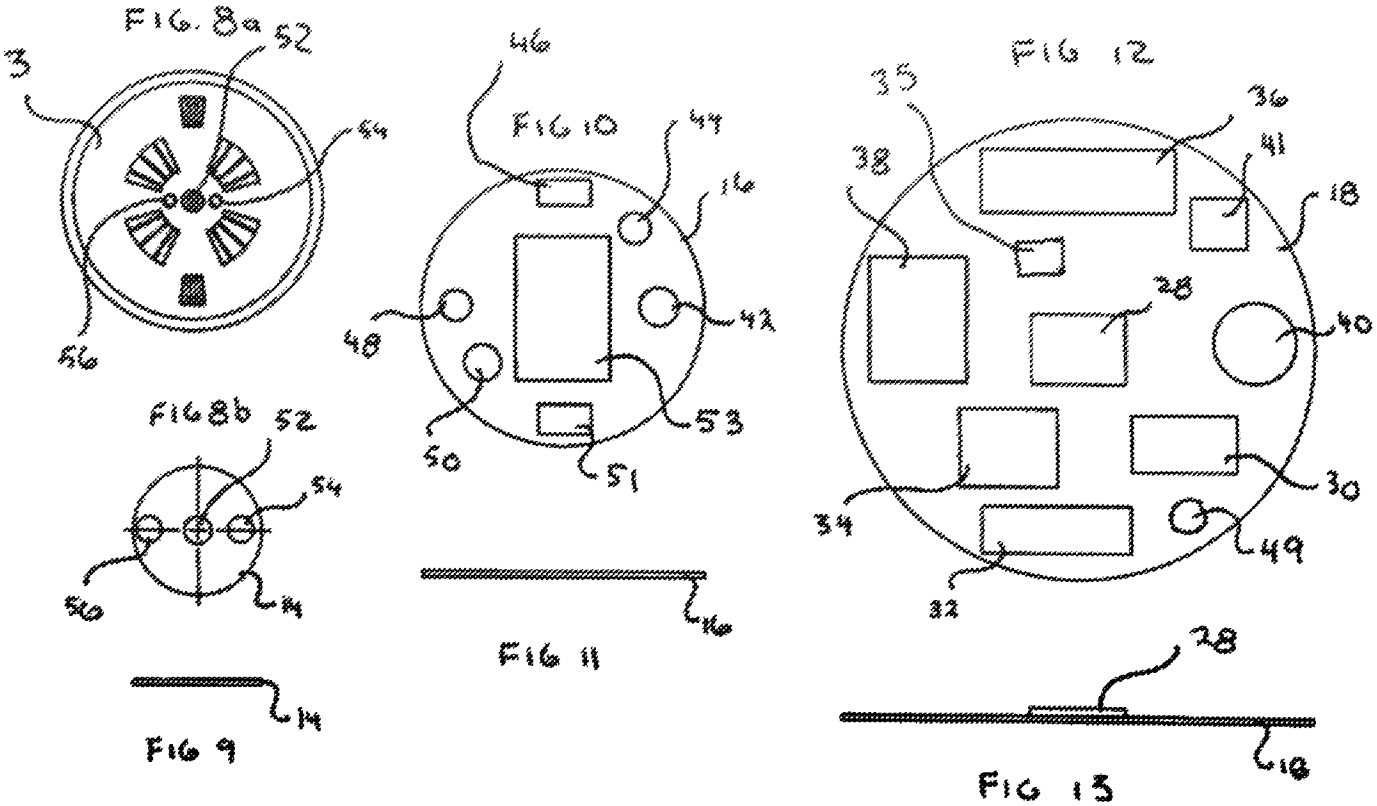
FIG. 8*a* is a top view of the circular shell.
FIG. 8*b* is a top view of the top PCB.
FIG. 9 is a side view of the top PCB.
FIG. 10 is a top view of the middle PCB.
FIG. 11 is a side view of the middle PCB.
FIG. 12 is a top view of the bottom PCB.
FIG. 13 is a side view of the bottom PCB.
Figure 14:
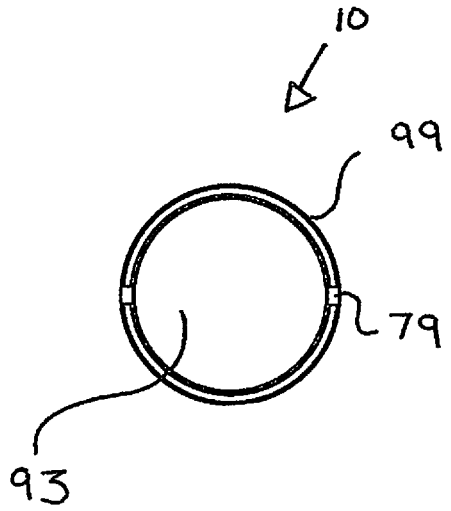
FIG. 14 is a side cross sectional view of a magnetic mount disk cup.
Figure 15:
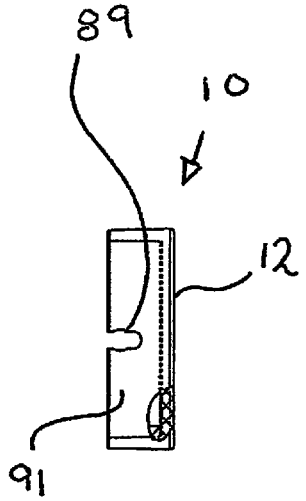
FIG. 15 is a top view of magnetic mount disk cup.
Figure 16:
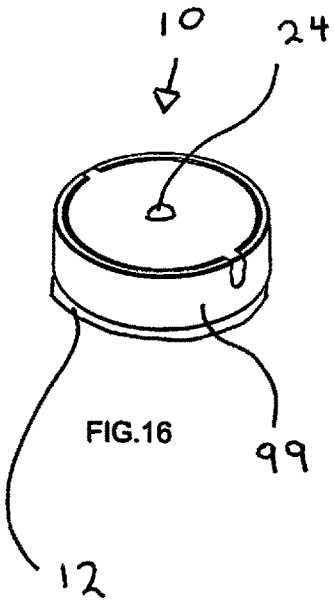
FIG. 16 is a front perspective view of the magnetic mount.
Figure 17:
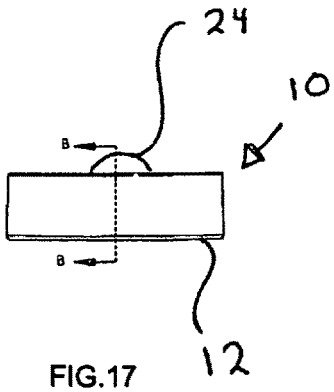
FIG. 17 is a side view of the magnetic mount showing section line 3-3.
Figure 18:
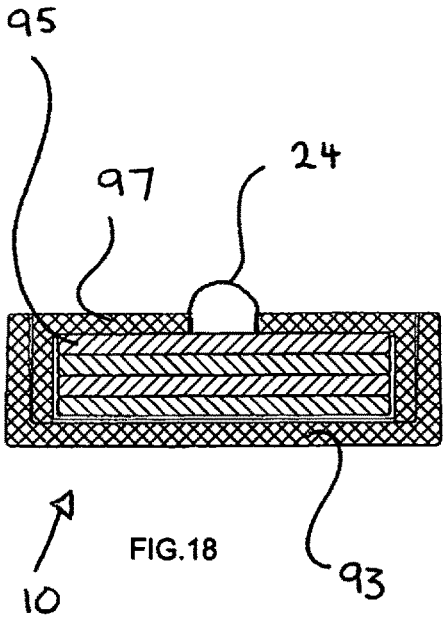
FIG. 18 is a cross sectional view of the magnetic mount.
Figure 19:
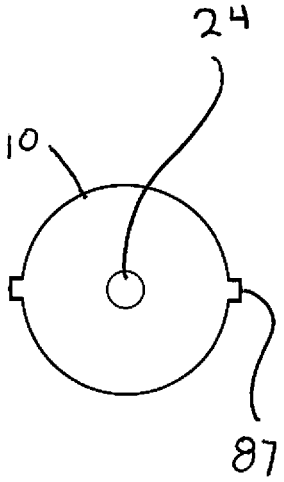
FIG. 19 is a top view of the magnetic mount cap.
Figure 20:
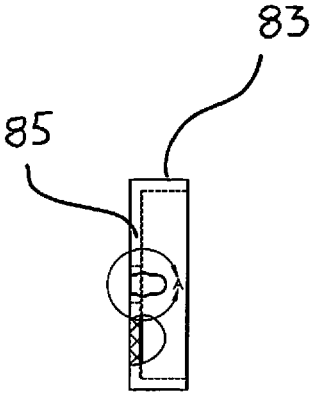
FIG. 20 is a side view of the magnetic mount cap with a section circle.
Figure 21:
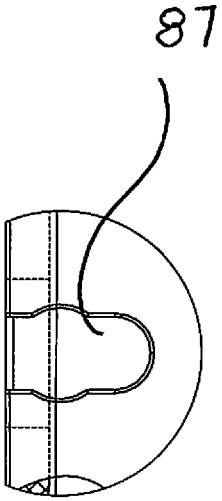
FIG. 21 is an enlargement of the section circle of FIG. 25.

Comparing FIGS. 4 and 6, the differences between the back face 20 and the front face 22 of the battery pack 8 can be seen. The battery pack 8 is formed as a circular disk with a magnetic mount 10 affixed to the battery's back face 20.

Looking at FIGS. 18-21 the magnetic mount 10 can best be explained. The magnetic mount 10 is made of a ferromagnetic concave mount cup 99, a mount cap 97 and at least one magnet 95, preferably a cylindrical stack of multiple rare earth magnets. The mount cup 99 is a circular cylindrical concave cup having a bottom plate 93 and a circular side wall 91 that has a pair of cap lock detents 89 cut into its side, 180 radial degrees apart. The cap lock detents 89 are conformed for mating engagement with side tabs 87 that extend perpendicularly from the side edge of the mount cap 97. The mount cap 97 is a circular cylinder also that has a planar top face 85 and a circular side wall 83 that defines an internal concavity sized to hold at least one circular magnet 95, preferably though, a stack of identical circular rare earth magnets 95. It also has a circular dome shaped button 24 centered on the outer side of the top face 85. This button 24 frictionally engages the central orifice in a mounting plate which is affixed to the premises. The button 24 ensures that the magnetic mount 10 is centered in the mounting plate because the matingly conformed orifice in the mounting plate is centered thereon. The base dimeter of the button 24 approximates the diameter of the orifice in the mounting plate, which in the preferred embodiment is 0.215 inches. The diameter of the button 24 is slightly less than the diameter of the orifice such that when the parts are joined the button side wall will contact the side wall of the orifice.

The exterior diameter of the circular side wall 83 is sized for frictional engagement within the concave mount cup 99. The entire magnetic mount is held together by three things: the magnetism between the magnet array and the ferromagnetic parts; the frictional engagement of the side tabs 87 of the mount cap 97 and the cap locks 79 of the mount cup 99; and the frictional engagement between the circular side wall 83 of the mount cap 97 and the inside of the concave mount cup 99. The assembled magnetic mount 10 holds the monitor in or on a mounting plate as discussed in U.S. patent application Ser. No. 16/987,161 entitled "Monitoring System Mount."

The magnetic mount 10 is affixed to the monitor by double sided tape 12 or any other suitable adhesive, placed between the back face of the mount cup 99 and the back face of the battery pack 8.

On the front (internal) face of the battery pack is an interface electronic connector 26 that connects to the power distribution plate 28 on the bottom PCB 18. This power distribution plate 28 takes the DC power from the battery pack 8 through the interface electronic connector 26 and distributes it to the microprocessor and electronic sensor circuitry on the three PCBs. The interface electronic connector also transfers power from the bottom face to the top face of the lower PCB 18.

Looking at FIGS. 8 to 13 the role of the three PCBs can best be explained. The bottom PCB 18 is the largest PCB. On it is centrally housed the CO sensor 41, the microphone 40, the power distribution plate 28, the piezoelectric alarm/speaker 30, the cellular network transceiver module 32, the radon detection sensor 34, the two-way voice/personal emergency response module 36, the video module 38, the battery power monitoring and alarm system module 35, and the smart hub module 49 (smart hub functionality).

The middle PCB 16 has a low temperature sensor 42, a humidity sensor 44, a NFPA compliant smoke detector sensor 46, a heat sensor 48, a combustible gas sensor 51, a shock sensor 50 and main system microprocessor 53.

The top PCB has a 360-degree fish eye camera 52, a 360-degree motion sensor 54 and a 360-degree glass break sensor 56.

In total, the monitor looks for an unwanted intruder (360 degree motion detector), the sound of a window shattering upon intrusion (glass break sensor) water line breaks or flooding (humidity sensor), fires (smoke detector) cooking appliances left on or faulty air conditioning (temperature sensor), furnace failure (low temperature sensor) earthquake tremors or physical tampering (shock sensor), radon gas (radon detection sensor), improperly exhausting fireplaces/stoves/dryers or garages (CO sensor) and gas leaks (combustible gas sensor). The sensors or sensor modules themselves are operably connected to the battery and system microprocessor 53. Some sensors and sensor modules may self-report monitored values outside of the limits sent in their set of instructions to the system microprocessor for further action. Other sensors and modules will be polled in an ongoing basis by the microprocessor, looking at the values for their monitored parameters then comparing them to the limits set in the microprocessor's instructions.

Once one of the monitored parameters exceeds the alert limit (either in the microprocessor or in its own structure) the microprocessor 53 takes several steps depending on what the monitored parameter was. First, in all cases, the microprocessor sends an alert to the owner's smart device via the cellular network module transceiver 32. Second, if it is a potentially dangerous situation such as smoke, CO, combustible gas, a glass break or motion detection, the microprocessor will initiate the piezoelectric siren speaker 30 and begin the live video feed from the fish eye camera 52 to the owner's smart device via the cellular network module transceiver 32, the microprocessor and the video module 38. Once notified, the owner can view the premises and communicate from his smart device through the microprocessor, the two-way voice/personal emergency response module 36 and piezoelectric alarm/speaker 30, and the video module 38. The monitor may also send the aforementioned alerts to a remote pay-for-use monitoring service that upon investigation may alert the owner and proper authorities for follow up.

With other minor, non-dangerous alerts such as high humidity, high or low temperature, shock sensation only an alert will be sent to the owner's smart device.

An important feature is that the monitor watches and sends a notification to the homeowner's smart device (smart phone, tablet or computer) as to the condition of the battery pack. (This prevents the rude mid-night awakening of a failing smoke detector battery.) Additionally, it can show the house internals and any motion therein (360-degree camera), as well as any sound in the house (emergency response module). Upon activation of any preset alarm/notification levels on the various sensors a signal is sent to the microprocessor for action. The microprocessor may contact the owner's smart device (phone) or a monitoring company via the cellular network module transceiver 32 or from the internet via the smart hub module 49.

The battery power monitoring and alarm system module 35 monitors the remaining capacity of the battery pack and reports this to the microprocessor which wirelessly transmits this information to the owner's smart device.

Z-Wave is a protocol preferably used for the smart hub and is a wireless radio frequency technology which operates at 908.42 MHz (in the US & Canada) that lets smart devices talk to and connect with one another. Here the various sensors and modules are made "smart" when Z-Wave connectivity is added, either directly if the sensors and modules are smart device enabled, or through the microprocessor and its operable connection to the sensors and modules, this gives them the capability to communicate and perform the desired functions from the owner's smart device when the proper software is loaded thereon. Thus, there is wireless two-way communication with each sensor or module through the smart hub module or the microprocessor and the cellular network module transceiver 32. In the preferred embodiment wireless Wi-Fi connectivity is not used. This is important with regard to the transmission of live video fees from the monitor's camera, which are much more stable and less subject to power unreliability.

With the monitor 2 connected to the internet through the smart hub module and also connected to the cellular network, signals can be sent in more than one way to the owner's smart cell phone. Since the microphone, video and audio modules are also connected to the smart hub module, the home owner may talk to people inside or just drop in and eves drop evesdrop on conversations therein or just survey the interior of the house. It can also be used as an intercom with the related cell phone application. Since all of the monitors are in wireless communication, seamless audible communication may be accomplished using the various microphones of the monitors scattered about the building.

It is envisioned that the integration with some of the commercially available digital assistants such as Siri, Alexa, Google and the equivalent will be future enhancements. The feature of facial recognition integrated with the camera will be operable through the cell phone application. With the smart hub module, all the other remote features of the smart home (door locks, thermostats, lights etc.) can all be seen and operated for the same software platform as the monitor uses.

In alternate embodiments, any combination of sensors and modules may be incorporated into the monitor, depending on what is trying to be protected. The monitor may be quite simple or quite complex. Facial recognition may also be incorporated into the microprocessor such that motion detection that initiates the camera feed allows the monitor to decide if it recognizes the intruder before sending an alert.

There will also be an outdoor version that besides the camera and motion detectors, may have an alarm LED light to illuminate the area (I.E. a back porch) when motion is present, as well as sensors for reporting general reportable atmospheric conditions such as barometric pressure, humidity, temperature and the like.

The concept herein being that every security and safety parameter is monitored or able to be monitored, and will send multiple notifications when an abnormality occurs; the system can be set up and installed by any DIY person; there will be no unsightly wiring or wall mounts; and adjustment of the monitor for optimal performance can be accomplished in minutes by the same DIY person. This will eliminate the cost of professional installation. With all of the various parameters available for monitoring, the home owner can purchase a set of comprehensive monitors and only sign up for commercial monitoring of the parameters they desire, with the option to add the others later. It also may act as a pet and baby camera, or an intercom. The associated application will allow the system to be set up without the conventional programing/alarm status panel.

Although not the subject of this patent application and not shown in the figures, the mounting plate in its preferred embodiment is a thin ferromagnetic steel plate with a generally planar, rectangular, central face having an array of substantially similar round orifices, where each orifice is sized for mating engagement with the alignment button 24 of the magnetic mount 10. The mounting plate is made of thin gauge metal approximately 0.034 inches thick in the preferred embodiment, and as such has a top stiffening flange and bottom stiffening flange to retain its planar configuration when loaded with a monitor. These two stiffening flanges project towards the rear normally (at approximately 90 degrees) from the plane of the central face from the top and bottom edges of the front face of the mounting plate. On each of the right and left side edges of the of the central face of the corner mounting plate, projecting at approximately 45 degrees from the plane of the central face, are left and right mounting flanges. In combination, these two mounting flanges will abut adjacent 90-degree walls at their corners and allow for the central face of the mounting plate to face the central region of the room.

The first point of novelty is that the monitor 2 incorporates security, safety and communication means into a battery powered (not hard wired) form that is able to provide alarm notification as well as visual/audible/voice communication to a remote smart device who can then communicate through the monitor to people/pets in the house. The alarm notification may come on the homeowner's phone computer or smart device as well as to a commercial security monitoring company via a cellular network. It requires no professional installer and with use of the aforementioned mounting plate, it can be aesthetically installed in minutes.

The second novelty of the present invention resides in its ability to be quickly affixed by any non-professional installer to any flat surface, in a centered, spaced configuration at any 90-degree corner, or in a centered spaced configuration at any angled wall—wall or wall—ceiling interface. The precise mounting of the monitor on any of the mounting plates may be accommodated by movement of the magnetic mount disk's button into any of the orifices in the orifice array on the mounting plate. In this way, the monitoring sensor may be rotated upon installation to direct any of its specific functional components into a preferred position. Once in place, the monitoring sensor can be removed for battery replacement, repair or alignment of one of its visual components with a simple tug of enough force to separate the rare earth magnet form its ferromagnetic mounting plate.

While certain features and aspects have been described with respect to exemplary embodiments, one skilled in the art will recognize that numerous modifications are possible. In the way of an example, it is envisioned that there will be portable versions for travelling salespersons, another for a doorbell location with limited features and night vision camera recording, and still another for use in the cars. The car device will have impact/collision sensors, glass break sensors, audible alarm, front and back recording cameras, facial recognition and the like. The home versions will offer both wired and wireless versions, and will have the option for cloud storage as well as that of monitoring company storage. This will allow full video and audio recording and storage directly from the house. A higher end option will be a directable camera that the homeowner can direct the view with, zoom in or set an auto follow feature on moving objects. Units for specific rooms or purposes may eliminate some or all of the sensors and modules as necessary and to fit the comfort levels of the owner.

Consequently, in view of the wide variety of permutations to the embodiments described herein, this detailed description and accompanying material is intended to be illustrative only, and should not be taken as limiting the scope of the inventive concept. What is claimed as the invention, therefore, is all such modifications as may come within the scope and spirit of the following claims and equivalents thereto.

What is claimed is:

1. A safety and security monitor, comprising;

a circular shell with a top face and a bottom face, said top face having at least one opening formed therethrough;

a battery pack having a top face and a bottom face, said top face affixed to said bottom face of said circular shell;

an interface electronic connector on said top face of said battery;

at least one printed circuit board housed within said circular shell, said circuit board having at least one sensor electrically connected thereon, said sensor selected from the set of sensors comprising a NFPA compliant smoke detector sensor, a glass break sensor, a shock sensor, a motion sensor; a CO sensor, a radon detection sensor, combustible gas sensor, a humidity sensor, a high heat sensor; a temperature sensor, a low temperature sensor;

a power distribution plate affixed on said at least one circuit board and electrically connected to said interface electronic connector for the transfer of power from said battery pack to said at least one printed circuit board;

an alarm/speaker affixed on said at least one printed circuit board;

a microphone affixed on said at least one printed circuit board;

a cellular network module transceiver affixed on said at least one printed circuit board;

a smart hub module affixed on said at least one printed circuit board;

a system microprocessor affixed to said at least one printed circuit board and operably connected to said power distribution plate, said battery pack, said alarm/speaker, said cellular network transceiver module, said microphone, said smart hub and said at least one sensor;

a magnetic mount having an upper planar face and a lower planar face, said lower planar face having a domed button extending therefrom, and said upper planar face affixed to a bottom face of said battery pack by an adhesive means.

2. The safety and security monitor of claim 1 wherein said magnetic mount is made of ferromagnetic concave mount cup;

a ferromagnetic mount cap sized for frictional engagement with, and residing within said concave mount cup, said mount cap having an upper planar face with a domed button centrally located thereon; and at least one magnet located within said mount cap.

3. The mount for a security or safety monitoring system of claim 1 wherein said adhesive means is a section of double-sided adhesive tape.

4. The safety and security monitor of claim 1 further comprising;

a 360 degree fish eye camera affixed on said at least one circuit board and operably connected to said microprocessor.

5. The safety and security monitor of claim 3 further comprising;

a 360 degree fish eye camera affixed on said at least one circuit board and operably connected to said microprocessor.

6. The safety and security monitor of claim 1 further comprising;

a two-way voice/personal emergency response module affixed on said at least one printed circuit board, said two-way voice/personal emergency response module operably connected to said microprocessor and said alarm/speaker.

7. The safety and security monitor of claim 3 further comprising;

a two-way voice/personal emergency response module affixed on said at least one printed circuit board, said two-way voice/personal emergency response module operably connected to said microprocessor and said alarm/speaker.

8. The safety and security monitor of claim 1 further comprising;

a video module affixed on said at least one printed circuit boards, said video module operationally connected to said microprocessor and said 360 degree fish eye camera.

9. The safety and security monitor of claim 3 further comprising;

a video module affixed on said at least one printed circuit boards, said video module operationally connected to said microprocessor and said 360 degree fish eye camera.

10. The safety and security monitor of claim 1 wherein the number of printed circuit boards is three, and said printed circuit boards are arranged in a stacked arrangement between the shell and the battery pack parallel to said bottom face of said shell, said printed circuit boards increasing in surface area and diameter from said top face of the shell to the bottom face of the shell.

11. The safety and security monitor of claim 3 wherein the number of printed circuit boards is three, and said printed circuit boards are arranged in a stacked arrangement between the shell and the battery pack parallel to said bottom face of said shell, said printed circuit boards increasing in surface area and diameter from said top face of the shell to the bottom face of the shell.

12. The safety and security monitor of claim 1 wherein the number of sensors is six, including;

a NFPA compliant smoke detector sensor;

a glass break sensor;

a motion sensor;

a CO sensor;

a combustible gas sensor; and a temperature sensor.

13. The safety and security monitor of claim 12 wherein the number of sensors is eleven, including;

a radon detection sensor;

a shock sensor;

a humidity sensor;

a high heat sensor; and a low temperature sensor.

14. An integrated security system, home automation system and communication system, comprising:

at least two safety and security monitors in wireless communication with each other, said at least two safety and security monitors each comprising:

a circular shell with a top face and a bottom face, said top face having at least one opening formed therethrough;

a battery pack having a top face and a bottom face, said top face affixed to said bottom face of said circular shell;

an interface electronic connector on said top face of said battery;

at least one printed circuit board housed within said circular shell, said circuit board having at least one sensor electrically connected thereon, said sensor selected from the set of sensors comprising a NFPA compliant smoke detector sensor, a glass break sensor, a shock sensor, a motion sensor; a CO sensor, a radon detection sensor, combustible gas sensor, a humidity sensor, a high heat sensor; a temperature sensor, a low temperature sensor;

a power distribution plate affixed on said at least one circuit board and electrically connected to said interface electronic connector for the transfer of power from said battery pack to said at least one printed circuit board;

an alarm/speaker affixed on said at least one printed circuit board;

a microphone affixed on said at least one printed circuit board;

a cellular network module transceiver affixed on said at least one printed circuit board;

a smart hub module affixed on said at least one printed circuit board;

a system microprocessor affixed to said at least one printed circuit board and operably connected to said power distribution plate, said battery pack, said alarm/speaker, said cellular network transceiver module, said smart hub, said microphone and said at least one sensor;

a magnetic mount having an upper planar face and a lower planar face, said lower planar face having a domed button extending therefrom, and said upper planar face affixed to a bottom face of said battery pack by an adhesive means.

15. The integrated security system of claim 14, further comprising:

a two-way voice/personal emergency response module affixed on said at least one printed circuit board, said two-way voice/personal emergency response module operably connected to said microprocessor, said microphone, said camera and said alarm/speaker.

* * * * *